US012295442B2

(12) United States Patent
Hinrichsen et al.

(10) Patent No.: US 12,295,442 B2
(45) Date of Patent: May 13, 2025

(54) ADJUSTABLE HELMET SHELL

(71) Applicant: RAWLINGS SPORTING GOODS COMPANY, INC., St. Louis, MO (US)

(72) Inventors: Mitch Hinrichsen, St. Louis, MO (US); Marc Schmidt, Weldon Spring, MO (US); Zach Runzo, Richmond Heights, MO (US)

(73) Assignee: RAWLINGS SPORTING GOODS COMPANY, INC., St. Louis, MO (US)

( * ) Notice: Subject to any disclaimer, the term of this patent is extended or adjusted under 35 U.S.C. 154(b) by 0 days.

(21) Appl. No.: 17/809,254

(22) Filed: Jun. 27, 2022

(65) Prior Publication Data

US 2023/0008101 A1 Jan. 12, 2023

Related U.S. Application Data

(60) Provisional application No. 63/218,647, filed on Jul. 6, 2021.

(51) Int. Cl.
*A42B 3/06* (2006.01)

(52) U.S. Cl.
CPC ..... *A42B 3/06* (2013.01)

(58) Field of Classification Search
CPC ..... A42B 3/324; A42B 3/064; A42B 3/32; A42B 3/127; A42B 3/145; A63B 71/10
See application file for complete search history.

(56) References Cited

U.S. PATENT DOCUMENTS

| | | | | |
|---|---|---|---|---|
| 3,042,927 | A * | 7/1962 | Mauro | A42B 3/324 2/418 |
| 5,661,854 | A * | 9/1997 | March, II | A42B 3/324 2/410 |
| 6,154,889 | A * | 12/2000 | Moore, III | A42B 3/324 2/418 |
| 11,700,903 | B2 | 7/2023 | Ferrari et al. | |
| 2001/0011388 | A1* | 8/2001 | Nelson | A42B 3/324 2/415 |
| 2007/0157370 | A1* | 7/2007 | Joubert Des Ouches | A42B 3/06 2/410 |
| 2016/0000168 | A1* | 1/2016 | Allen | A42B 3/08 2/414 |
| 2022/0386735 | A1* | 12/2022 | Agustsson | A42B 3/283 |

FOREIGN PATENT DOCUMENTS

| | | | | |
|---|---|---|---|---|
| CA | 2749912 | A1 * | 2/2013 | A42B 3/324 |

* cited by examiner

*Primary Examiner* — Katherine M Moran
*Assistant Examiner* — Grady Alexander Nunnery
(74) *Attorney, Agent, or Firm* — Perkins Coie LLP

(57) ABSTRACT

A helmet with an adjustable helmet shell is provided for use in sports including baseball and softball. The helmet shell is expandable and contractable to fit a variety of head shapes and sizes, and hairstyles. The helmet shell may be a single, molded piece or it may include a base member and a flap member. Gaps or slots may be located between flexible side portions and a flexible rear portion of the helmet shell. The slots facilitate outward deflection of the side portions and the rear portion when the helmet is donned. The helmet shell may be biased toward a smaller size such that once the helmet shell is expanded by the force of a wearer's head, it contracts to fit snugly and securely.

17 Claims, 7 Drawing Sheets

ADJUSTABLE HELMET SHELL

CROSS-REFERENCE TO RELATED APPLICATIONS

This application claims the benefit of and priority to U.S. Provisional Patent Application No. 63/218,647, filed Jul. 6, 2021, which is incorporated herein by reference in its entirety.

FIELD OF THE INVENTION

Embodiments of the present technology relate to a helmet having an adjustable or flexible protective helmet shell. More particularly, the present technology relates to an adjustable or flexible helmet shell that can accommodate various head shapes and sizes.

BACKGROUND

Protective helmets are worn by participants in a variety of activities and sports, including but not limited to, baseball, softball, football, lacrosse, cycling, and hockey to help protect the wearer's head from trauma. However, such helmets are usually mass produced, and they therefore cannot appropriately fit the head of every possible wearer, or even a majority of wearers. This can result in discomfort.

Inappropriately fitting helmets are also inconvenient, particularly in youth sports. Oftentimes players share helmets, and finding helmets that fit a variety of head shapes and sizes may be difficult. Even if a player has his or her own helmet, that helmet may stop fitting comfortably if a player does something as simple as changing a hairstyle or getting a haircut.

Some helmet manufacturers attempt to solve this problem by designing helmets that have liners inside that aim to conform with the wearer's head. Such liners are made of a variety of materials, including thick, open-cell foam. Other manufacturers utilize dial-fit systems that adjust straps to make the helmet fit more snugly on the user's head. Another available system is a manual inflatable liner within a helmet's interior that can be adjusted using a pump.

The aforementioned liners and systems are often expensive, difficult to assemble, inconvenient to use, or may lack in actual performance.

SUMMARY

The present technology provides a helmet with a helmet shell that allows wearers with a variety of head shapes and sizes to wear the helmet. The helmet may be used in several different sports, including but not limited to baseball and softball. The helmet shell may be a single, molded piece or it may include a base member and a flap member. Like known helmet shells in the art, the helmet shell may include foam or another energy absorber attached to its interior.

In the single-piece embodiment, the helmet shell may include gaps or slots between the side and rear portions of the shell to facilitate outward flexing of those regions when a wearer dons the helmet. In the embodiment with a base member and a flap member, the flap member may be hingedly attached to the top portion of the rear of the helmet and extend downwardly toward a wearer's neck. The base member may include a gap or cutout in its rear portion where the flap member is positioned.

In some embodiments, the helmet shell provides an outward flexing action in both the sides and rear to adjust to different head sizes and shapes. When the helmet is not worn, the shell's resting position may be slightly smaller than the intended smallest-sized head. The helmet shell may be biased to this resting position. When the helmet is donned, a wearer's head generates an outward force on the side and rear portions of the helmet shell. This outward force causing the helmet shell to flex outwardly while creating a snug and secure fit on the wearer's head.

In operation, when the helmet is donned, the rear portion of the helmet shell may flex or rotate outwardly or upwardly, and the side portions of the helmet shell may distance from each other to increase the helmet-shell size in front-to-back (forehead to back of head) and side-to-side (ear-to-ear) directions. Depending on the size and shape of a wearer's head, the side portions of the helmet shell may deflect outwardly, or the rear portion of the helmet may deflect rearwardly, or both, thus expanding the helmet shell's size in one or both directions to fit a wearer's head. Because the helmet shell has a natural inclination or bias to return to its smallest size when resting, the fit is preferably snug and secure.

In some embodiments, the rear and side portions of the helmet shell may be connected to each other by one or more limiting straps that limit the distance the helmet shell can outwardly deflect, thus preventing the helmet from becoming too loose. The limiting straps may be elastic or inelastic, or a combination of both.

BRIEF DESCRIPTION OF THE DRAWINGS

In the drawings, wherein the same reference number indicates the same element throughout the views.

Figure 1:
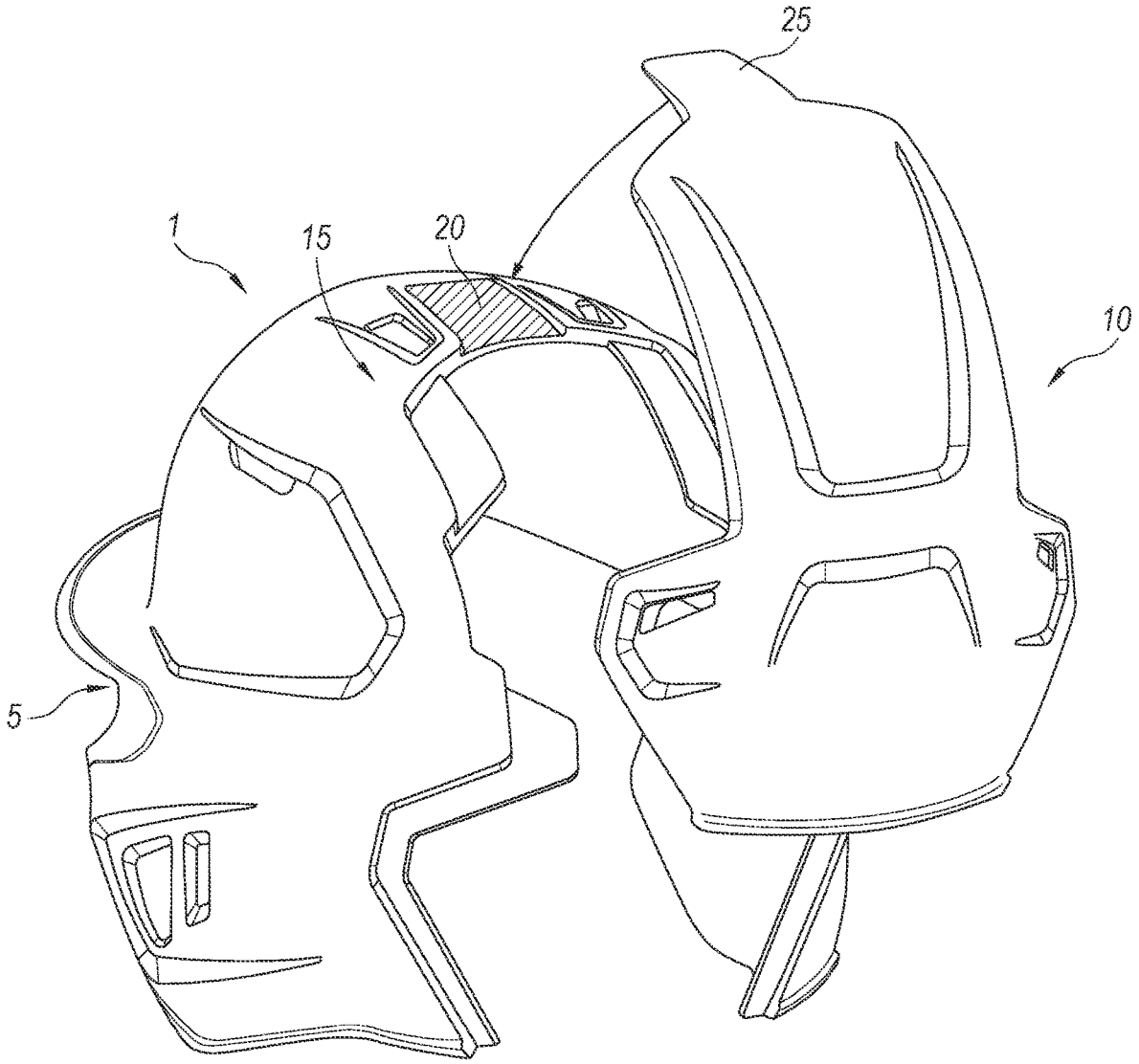
FIG. 1 is an exploded view of an adjustable helmet shell constructed according to one embodiment of the present technology.

While the disclosure is susceptible to various modifications and alternative forms, specific embodiments thereof are shown by way of example in the drawing and will herein be described in detail. It should be understood, however, that the drawings and detailed description presented herein are not intended to limit the disclosure to the particular embodiment disclosed but, on the contrary, the intention is to cover all modifications, equivalents, and alternatives falling within the spirit and scope of the present disclosure.

DETAILED DESCRIPTION

The present technology will now be described with reference to the drawings, in which like reference numerals refer to like parts throughout. For purposes of clarity in illustrating the characteristics of the present technology, proportional relationships of the elements have not necessarily been maintained in the drawing figures.

The present technology is directed to adjustable helmets. Various embodiments of the technology will now be described. The following description provides specific details for a thorough understanding and enabling description of these embodiments. One skilled in the art will understand, however, that the invention may be practiced without many of these details. Additionally, some well-known structures or functions, such as those common to helmets and materials suitable for use in helmets, may not be shown or described in detail to avoid unnecessarily obscuring the relevant descriptions of the various embodiments. Accordingly, embodiments of the present technology may include additional elements or exclude some of the elements described below with reference to FIGS. 1-7, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Turning to FIG. 1, a helmet shell 1 is illustrated in exploded view. The helmet shell 1 may be donned by a wearer for use in a variety of sports including but not limited to baseball and softball. Like known helmet shells in the art, the helmet shells described herein may be made of a polymeric material, such as carbon fiber, or of a durable plastic, such as ABS (Acrylonitrile Butadiene Styrene), or of another suitable material. The helmet shells may also include foam or another known or foreseeable compressible material attached to their interior portions (not illustrated) in order to improve fit and comfort, and to further absorb any blows to the helmet via batted or thrown balls, or the like.

The helmet shell 1 may be provided in a variety of shapes and sizes. In some embodiments, the helmet shell 1 may include a base member 5 and a flap member 10. The flap member 10 is preferably attached to a top portion 15 of the base member 5 near where the helmet shell 1 would rest on the crown of a wearer's head. The flap member 10 may be attached to the base member 5 in a number of ways but, in any embodiment, it is preferably hingedly attached to the base member 5 so that it may rotate rearwardly away from the base member 5. In some embodiments, the hinged attachment may be a living hinge. For example, the flap member 10 may be attached to the base member 5 via radio frequency welding, though a nearly limitless number of alternative attachment methods are foreseeable. In some embodiments, similar to the embodiment described below with respect to FIGS. 5-7, the flap member 10 may be molded with the base member 5 to form a single, integral apparatus.

In the embodiment of FIG. 1, the base member 5 includes a slot member 20 to which the flap member 10 may be attached. The flap member 10 may include an extension member 25 that is sized and shaped to mate with the slot member 20. The slot member 20 and the extension member 25 may be slightly curved to facilitate rotation of the flap member 10 relative to the base member 5.

Figure 2:
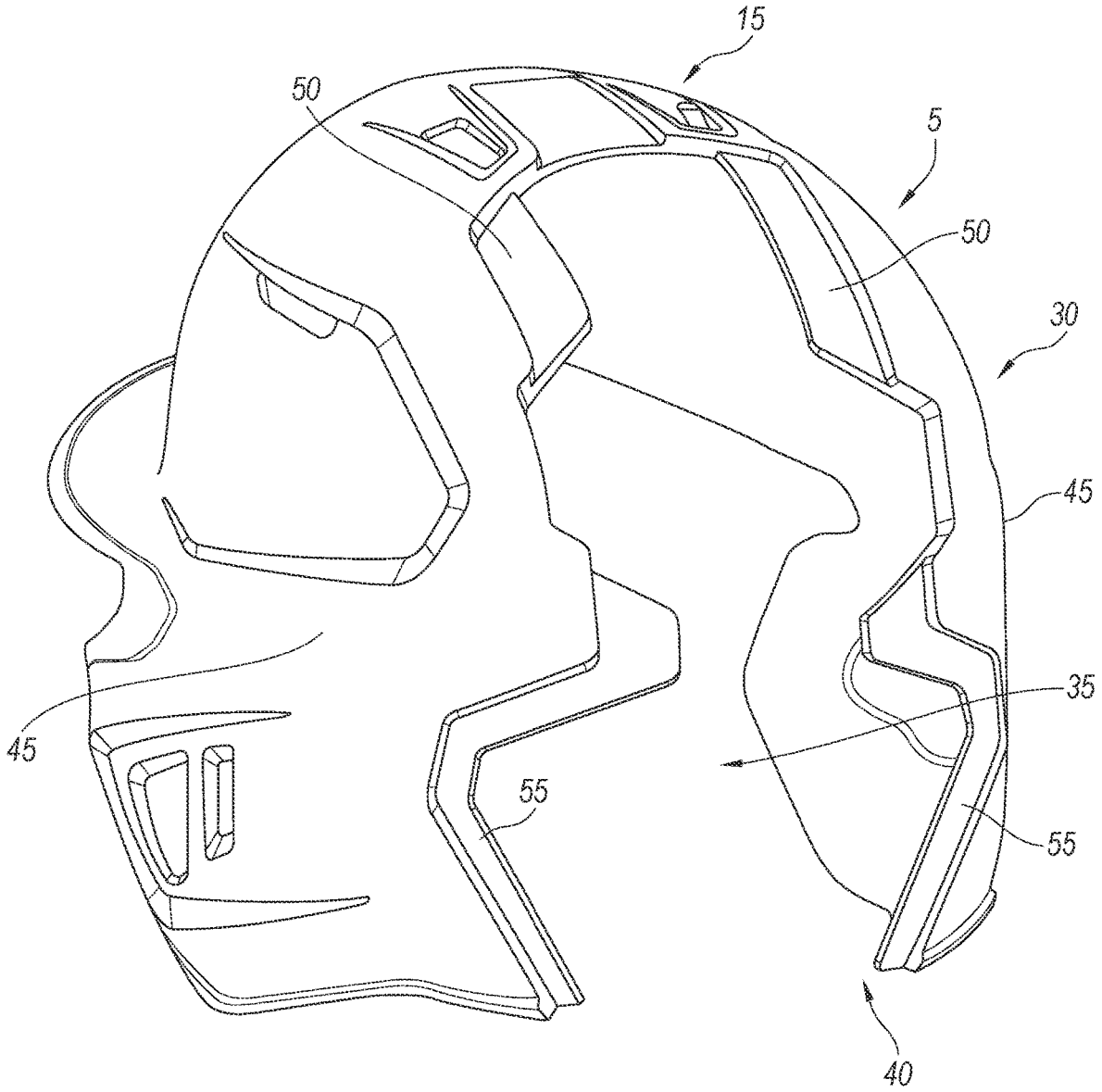
FIG. 2 is a perspective view of a helmet shell base of the helmet shell of FIG. 1.

Turning to FIG. 2, the base member 5 is illustrated with the flap member 10 removed. As illustrated, a rear portion 30 of the base member 5 includes a cut-out portion 35 having a shape that is substantially similar to the shape of the flap member 10 so that the flap member 10 may nest therein when connected to the base member 5. In the embodiment illustrated in FIG. 2, the cut-out portion 35 is wider nearer the top portion 15 of the base member 15 than a lower portion 40 of the base member 5. The shape and configuration of the cut-out portion 35 may vary in alternative constructions. The cut-out portion 35 preferably allows side portions 45 of the base member 5 to be pulled away from each other when the helmet is expanded to fit the wearer, as set forth in greater detail below.

Adjacent to the cut-out portion 35, the base member 15 may include first and second sets of extension members 50, 55. The first or upper extension members 50, and the second or lower extension members 55, preferably extend from the base member 5 inwardly toward the cut-out portion 35. The upper extension members 50 are preferably nearer to the top portion 15 of the base member 5, while the lower extension members 55 are preferably nearer the lower portion 40. The extension members 50, 55 may fit beneath and overlap with the flap member 10 so that when the helmet shell 1 is expanded, the extension members 50, 55 may obscure gaps that would otherwise be visible between the base member 5 and the flap member 10. Other numbers or configurations of extension members may be used.

Figure 3:
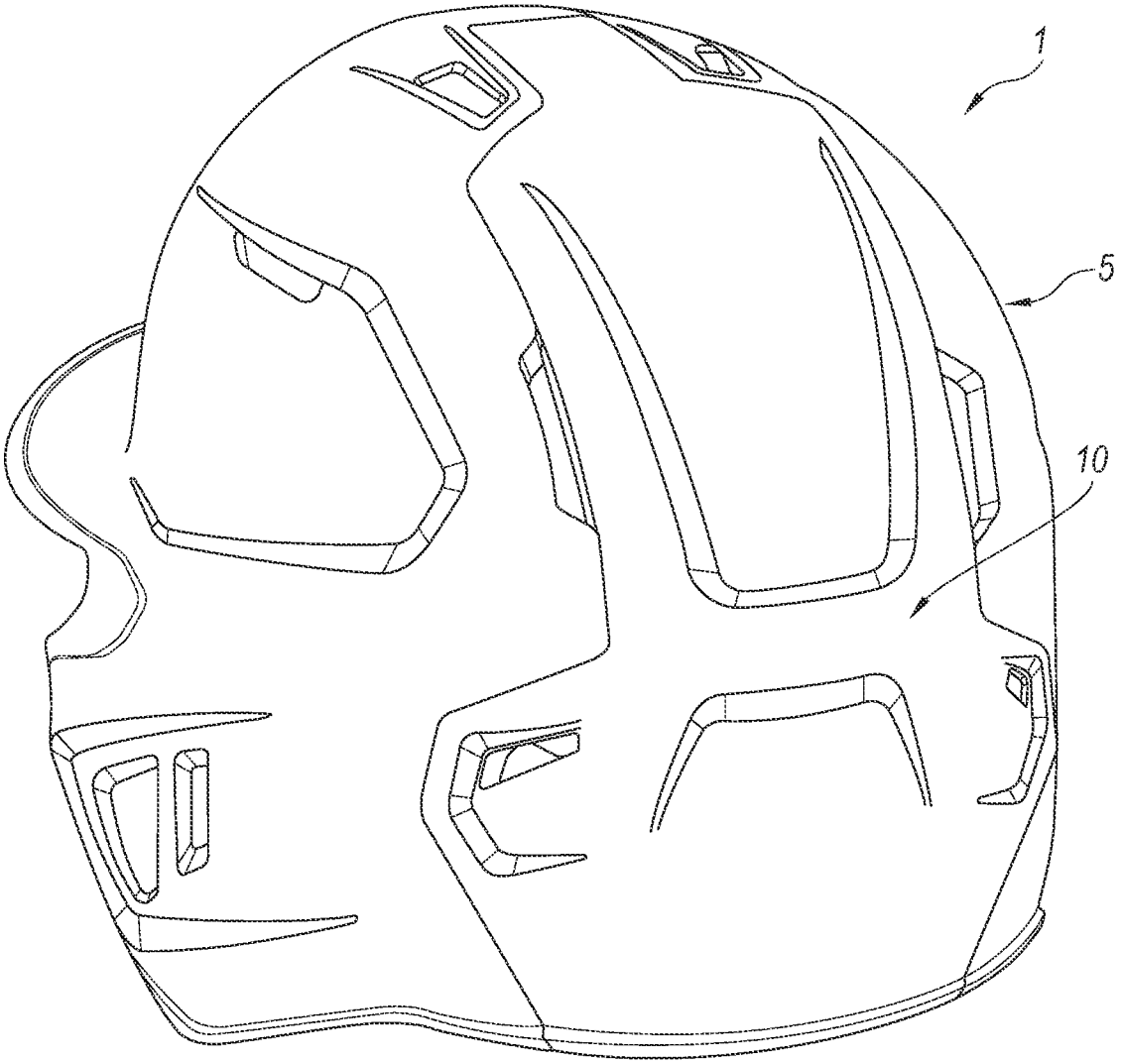
FIG. 3 is a rear perspective view of the adjustable helmet shell of FIG. 1 in a contracted position.
Figure 4:
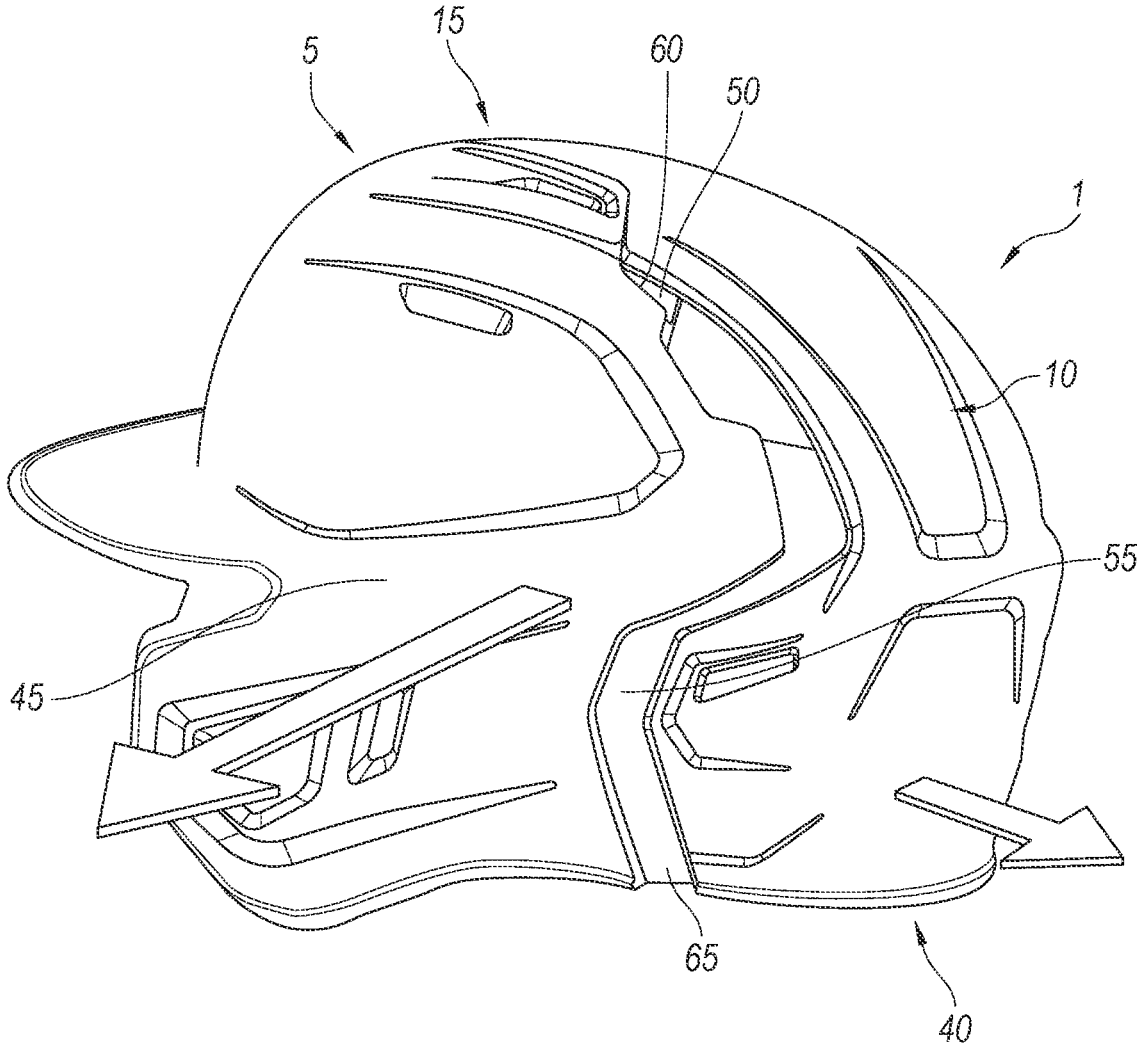
FIG. 4 is a side perspective view of the helmet shell of FIGS. 1 and 3 in an expanded position.

FIGS. 3 and 4 illustrate the helmet shell 1 when the flap member 10 is connected to the base member 5. In FIG. 3, the helmet shell 1 is in a contracted position, and in FIG. 4, it is in an expanded position. In the contracted position, the helmet shell 1 is preferably biased such that it is resting at its smallest size, optionally at a size that is slightly smaller than the intended smallest-sized head.

When the helmet shell 1 is donned, the helmet shell 1 may experience an outward force generated by a wearer's head. Upon application of such force, the flap member 10 may rotate rearwardly, or the side portions 45 of the base member 5 may distance from each other such that the helmet-shell size increases in the front-to back or side-to-side directions, or both, as provided in FIG. 4. The side portions 45 of the base member 5 expanding or the flap member 10 rearwardly rotating expands the size of the shell 1 in one or both directions to fit a wearer's head. Because the helmet shell 1 has a natural inclination to return to its smallest size when resting, the fit is preferably snug and secure.

Distancing of the side portions 45 from each other may generate a gap 60 and a gap 65 between the flap member 10 and the base member 5 near the top portion 15 and the lower portion 40 of the helmet shell 1. However, to improve the appearance of the helmet shell 1 and to further prevent gaps 60, 65 from being visible or exposing the wearer's head to dirt, debris, or the possibility of being hit by a batted or thrown ball, the extension members 50, 55 may effectively cover the gaps 60, 65, as illustrated in FIG. 4.

Figure 5:
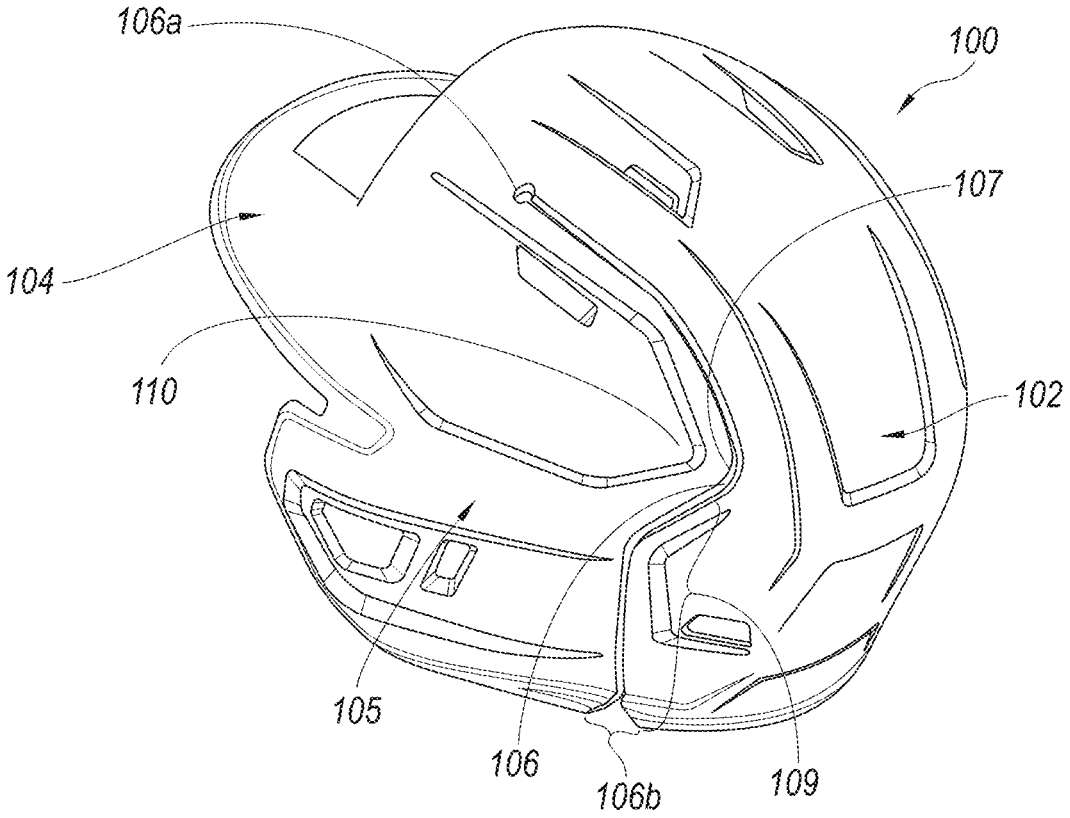
FIG. 5 is side perspective view of an adjustable helmet shell according to another embodiment.
Figure 6:
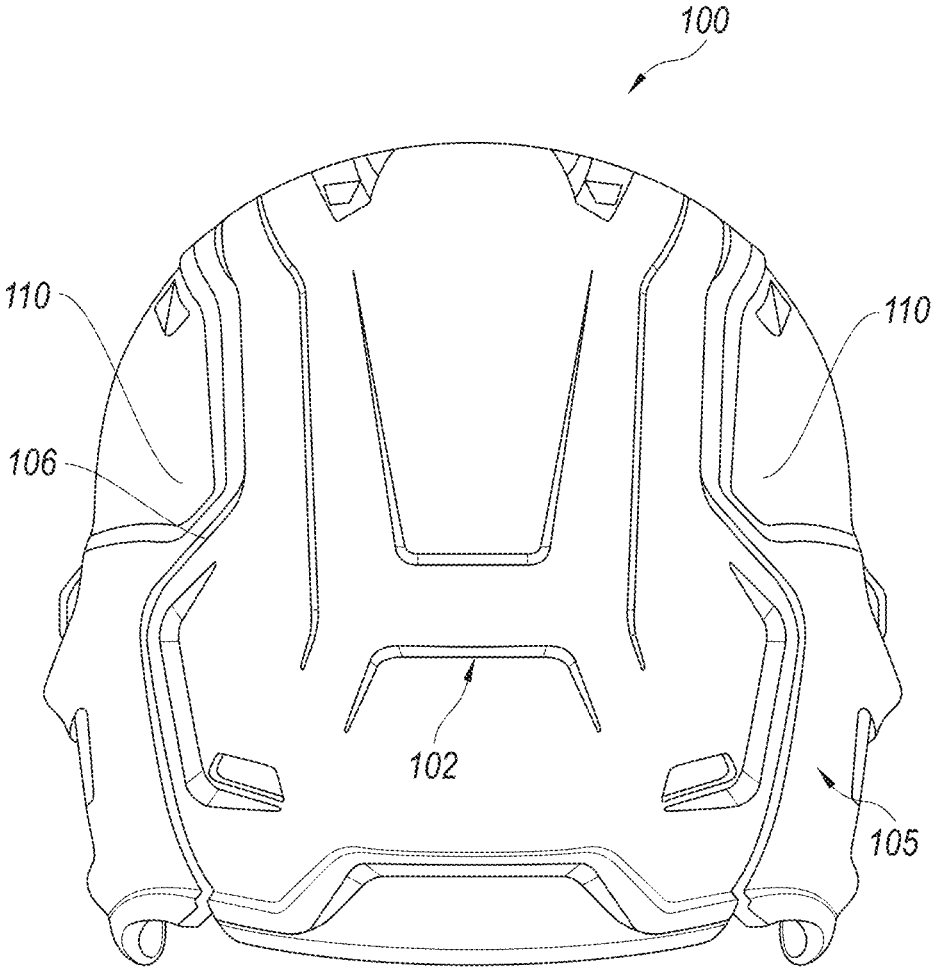
FIG. 6 is a rear perspective view of the adjustable helmet shell of FIG. 5.
Figure 7:
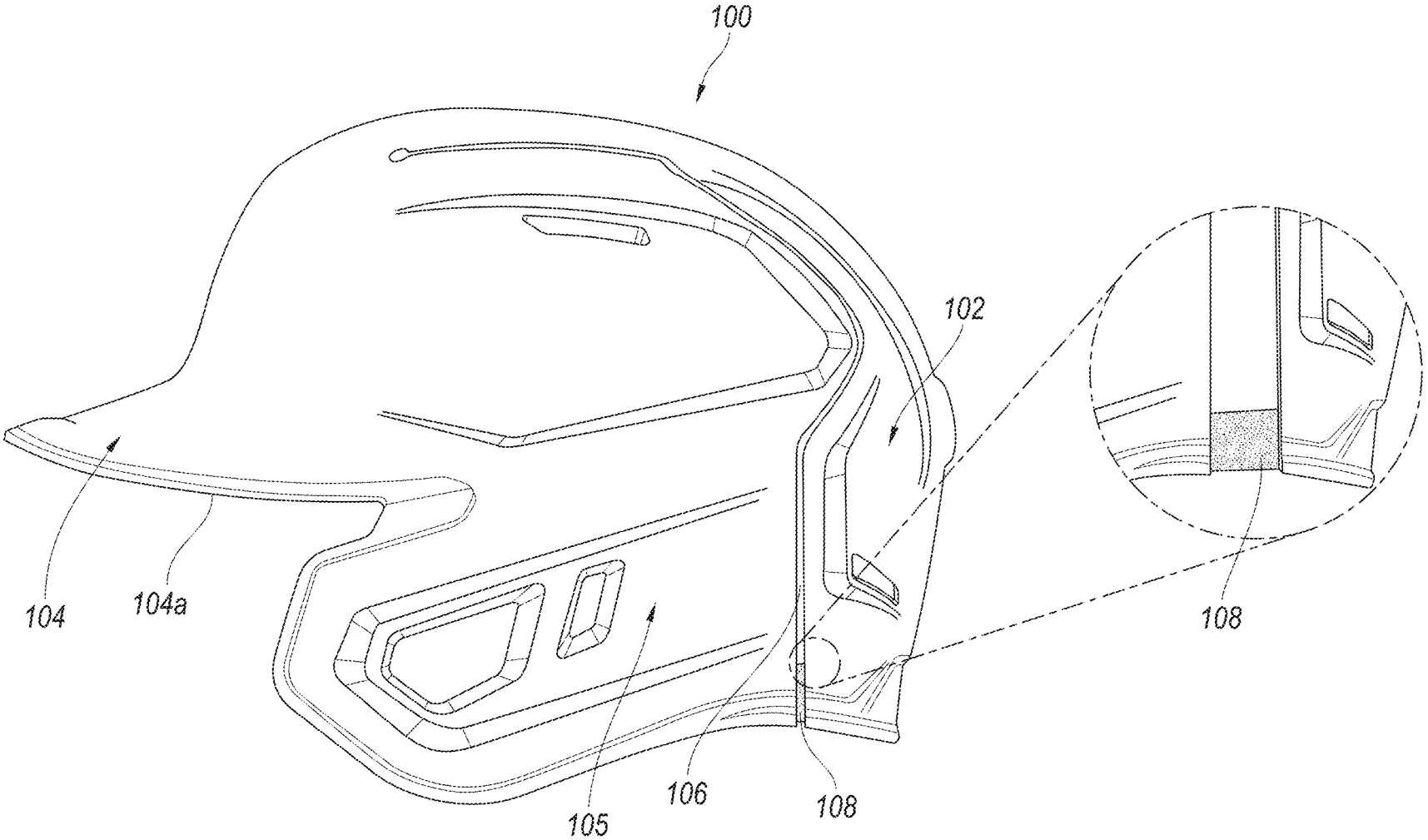
FIG. 7 is a side perspective view of the adjustable helmet shell of FIGS. 5 and 6, including a magnified view of a limiting strap region of the helmet.

FIGS. 5-7 illustrate another embodiment in which the helmet includes a one-piece, adjustable helmet shell 100. The helmet shell 100 includes a flexible rear portion 102, a front portion 104, and flexible side portions 105. Each of the side portions 105 may be integral with the front portion 104. Gaps or slots 106 in the helmet shell 100 separate the side portions 105 from the rear portion 102 and optionally from at least part of the upper region of the helmet shell 100. Each of the side portions 105 may extend rearwardly from the front portion 104 to a corresponding side location 107 that is farther from the front portion 104 than a portion 109 of a corresponding slot 106 below the corresponding side location 107

The slots 106 may extend from the upper region (i.e., from a corresponding upper terminal end 106*a* of each slot 106) to the bottom of the helmet shell 100 (i.e., to a corresponding bottom terminal opening 106*b* of each slot 106), such that the side portions 105 and the rear portion 102 are separated from, and not connected to, each other. This separation may allow for less restricted movement than embodiments in which the rear portion overlaps the side portions of the helmet shell. The slots 106 may alternatively begin in the front portion 104 of the helmet shell 100 or in the side portions 105 of the helmet shell, such that the slots 106 may be longer or shorter than those shown in the figures.

The slots 106 may change direction one or more times. In the illustrated example, the slots 106 extend rearward, then downward and forward, then generally straight downward to the bottom of the helmet shell 100. In the illustrated example, each side portion may include a rearwardly projecting portion 110 formed by the corresponding slots 106 changing direction. In some embodiments, each rearwardly projecting portion 110 may extend rearwardly beyond the bottom terminal opening 106*b* of the corresponding adjacent slot 106 (e.g., to the location 107). In some embodiments, the bottom terminal opening 106*b* of each slot 106 is entirely rearward of the upper terminal end 106*a* of the slot 106. Other slot arrangements may be used to facilitate additional or reduced deflection, or deflection in other regions of the helmet shell 100.

As shown in FIG. 7, the helmet may include one or more limiting straps 108, or other suitable components, connected between the side portions 105 and the rear portion 102 of the helmet shell 100 to limit the separation or maximum deflection between the side portions 105 and the rear portion 102. In some embodiments, a first limiting strap 108 is attached to the left-side portion 105 and the rear portion 102, and a second limiting strap 108 is attached to the right-side portion 105 and the rear portion 102. The limiting straps 108 may be attached to the side portions 105 and rear portion 102 via rivets, screws, bolts, welds, or any other suitable connectors. The limiting straps 108 may be made of an elastic or inelastic material, or a combination of both materials that allows for an initial stretch while providing a rigid stop at the maximum extension point. In some embodiments, one or more of the limiting straps 108 is positioned entirely within a perimeter of the outer surface 111 of the helmet shell 100. In some embodiments, an entirety of each limiting strap 108 is positioned lower than a lower edge 104*a* of the front portion 104.

Similar to the embodiment shown in FIGS. 1-4, when the helmet is donned, force generated by a wearer's head outwardly deflects the side portions 105, or the rear portion 102, or both, such that the helmet-shell size increases in the front-to back or side-to-side directions, or both. Because the helmet shell 100 returns to its smallest size when resting, the fit is preferably snug and secure.

From the foregoing, it will be appreciated that specific embodiments of the disclosed technology have been described for purposes of illustration, but that various modifications may be made without deviating from the technology, and elements of certain embodiments may be interchanged with those of other embodiments, and that some embodiments may omit some elements.

While advantages associated with certain embodiments of the disclosed technology have been described in the context of those embodiments, other embodiments may also exhibit such advantages, and not all embodiments need to exhibit such advantages to fall within the scope of the technology. Accordingly, the disclosure and associated technology may encompass other embodiments not expressly shown or described herein.

What is claimed is:

1. An adjustable helmet, comprising:

a helmet shell including a front portion, a top portion, a left-side portion, a right-side portion, and a rear portion;

a first slot between the left-side portion and the rear portion, the first slot extending to a bottom of the helmet shell such that the left-side portion and the rear portion are separated from each other;

a second slot between the right-side portion and the rear portion, the second slot extending to the bottom of the helmet shell such that the right-side portion and the rear portion are separated from each other; and one or more limiting straps positioned entirely within a perimeter formed by an outer surface of the helmet shell;

wherein:

the first and second slots facilitate outward deflection of the left-side portion, the right-side portion, and the rear portion when the helmet is donned;

the one or more limiting straps are configured to limit the deflection of at least one of the left-side portion, the right-side portion, or the rear portion;

the left-side portion is integral with the front portion;

the right-side portion is integral with the front portion;

the left-side portion extends rearwardly from the front portion to a left-side location that is farther from the front portion than a portion of the first slot below the left-side location;

the right-side portion extends rearwardly from the front portion to a right-side location that is farther from the front portion than a portion of the second slot below the right-side location;

at least part of the first slot is between the top portion and the left-side portion; and at least part of the second slot is between the top portion and the right-side portion.

2. The helmet of claim 1, wherein the one or more limiting straps comprises a first limiting strap connecting the left-side portion to the rear portion, and a second limiting strap connecting the right-side portion to the rear portion.

3. The helmet of claim 2 wherein the first and second limiting straps comprise at least one of an elastic material or an inelastic material.

4. The helmet of claim 2 wherein the first and second limiting straps comprise an elastic material and an inelastic material.

5. The helmet of claim 1 wherein the first and second slots change direction at least twice.

6. The helmet of claim 1 wherein the first and second slots change direction at least three times.

7. The helmet of claim 1 wherein the first and second slots extend rearward from the top portion, then downward and forward, then generally straight downward to the bottom of the helmet shell.

8. The helmet of claim 1 wherein the helmet shell is biased to a resting position that is smaller than the smallest-sized head for which the helmet is configured.

9. An adjustable helmet, comprising:

a helmet shell including a front portion, a top portion, a left-side portion, a right-side portion, and a rear portion;

a first slot between the rear portion and the left-side portion, the first slot extending to a bottom of the helmet shell such that the left-side portion is separated from the rear portion; and a second slot between the rear portion and the right-side portion, the second slot extending to the bottom of the helmet shell such that the right-side portion is separated from the rear portion;

wherein:

the first slot and the second slot are configured to facilitate outward deflection of at least one of the left-side portion, the right-side portion, or the rear portion;

each of the left-side portion, the rear portion, and the right-side portion is biased (a) toward a resting position in which the first slot has a first width, and (b) away from an expanded position in which the first slot has a second width that is greater than the first width;

the left-side portion comprises a first rearwardly projecting portion;

the first rearwardly projecting portion extends rearwardly beyond a bottom opening of the first slot;

the bottom opening of the first slot is entirely rearward of a top terminal end of the first slot; and the right-side portion comprises a second rearwardly projecting portion.

10. The helmet of claim 9 wherein each of the first slot and the second slot extends to the top portion of the helmet shell.

11. The helmet of claim 9, further comprising a first limiting strap connected to the left-side portion and the rear portion, and a second limiting strap connected to the right-side portion and the rear portion, wherein the first and second limiting straps are configured to limit the deflection of at least one of the left-side portion, the right-side portion, or the rear portion.

12. The helmet of claim 11, wherein each of the limiting straps is positioned entirely inside a perimeter formed by an outer surface of the helmet shell.

13. The helmet of claim 9 wherein each of the first slot and the second slot changes direction at least twice.

14. The helmet of claim 9 wherein each of the first slot and the second slot extends rearward from the top portion, then downward and forward, then generally straight downward to the bottom of the helmet shell.

15. The helmet of claim 9 wherein when the helmet shell is in the resting position, the helmet shell is smaller than the smallest-sized head for which the helmet is configured.

16. The helmet of claim 9, wherein:

the rear portion comprises a left-side forwardly projecting portion adjacent to the bottom of the helmet shell;

the rear portion comprises a right-side forwardly projecting portion adjacent to the bottom of the helmet shell;

the first slot is positioned between the left-side forwardly projecting portion and the first rearwardly projecting portion; and the second slot is positioned between the right-side forwardly projecting portion and the second rearwardly projecting portion.

17. The helmet of claim 9, wherein each of the first slot and the second slot extends from an outer surface of the helmet through an entire thickness of the helmet.

* * * * *